US009339067B2

(12) United States Patent
Feuchs

(10) Patent No.: US 9,339,067 B2
(45) Date of Patent: May 17, 2016

(54) MULTI-PURPOSE TRAINING APPARATUS AND METHOD

(76) Inventor: Ronald Gary Feuchs, Cross River, NY (US)

( * ) Notice: Subject to any disclaimer, the term of this patent is extended or adjusted under 35 U.S.C. 154(b) by 650 days.

(21) Appl. No.: 13/442,490

(22) Filed: Apr. 9, 2012

(65) Prior Publication Data

US 2012/0255097 A1 Oct. 11, 2012

Related U.S. Application Data

(60) Provisional application No. 61/473,975, filed on Apr. 11, 2011.

(51) Int. Cl.

| | |
|---|---|
| ***A41D 13/00*** | (2006.01) |
| ***A41D 13/06*** | (2006.01) |
| ***A63B 69/00*** | (2006.01) |
| ***A63B 21/065*** | (2006.01) |
| ***A63B 21/075*** | (2006.01) |
| *A63B 71/12* | (2006.01) |

(52) U.S. Cl.

CPC ..... *A41D 13/065* (2013.01); *A63B 21/065* (2013.01); *A63B 21/075* (2013.01); *A63B 21/4011* (2015.10); *A63B 69/004* (2013.01); *A63B 2071/1258* (2013.01); *A63B 2209/10* (2013.01)

(58) Field of Classification Search

CPC ..... A63B 2071/1258; A63B 2071/1266; A41D 13/0568

USPC ..... 482/105, 124; 2/22, 23–24, 911, 455, 2/908, 919, 1; 473/438, 420, 437, 471, 473/425, 450, 452, 458, 464, 59; 128/DIG. 15

See application file for complete search history.

(56) References Cited

U.S. PATENT DOCUMENTS

| | | | | | |
|---|---|---|---|---|---|
| 2,241,833 | A | * | 5/1941 | Waller | 482/105 |
| 3,278,184 | A | * | 10/1966 | Rosenbaum | 482/105 |
| 3,334,898 | A | * | 8/1967 | McCrory et al. | 482/105 |
| 3,366,380 | A | * | 1/1968 | Montour | 482/105 |
| 3,406,968 | A | * | 10/1968 | Mason | 482/105 |
| 3,528,652 | A | * | 9/1970 | Tarbox | 482/105 |
| 3,534,957 | A | * | 10/1970 | Houston et al. | 473/438 |
| 4,192,502 | A | * | 3/1980 | Owen | 482/105 |
| 4,838,546 | A | * | 6/1989 | Winston | 482/105 |
| 4,911,434 | A | * | 3/1990 | Herring | 482/105 |
| 4,966,365 | A | * | 10/1990 | Winston | 482/105 |
| 4,997,183 | A | * | 3/1991 | Winston | 482/105 |
| 5,075,902 | A | * | 12/1991 | McReynolds et al. | 2/238 |
| 5,127,891 | A | * | 7/1992 | Winston | 482/50 |
| 5,169,364 | A | * | 12/1992 | Donaldson | 482/105 |
| 5,553,322 | A | * | 9/1996 | Cebo-Johnson | A63B 21/065 2/69 |
| 5,978,964 | A | * | 11/1999 | Gaston | A63B 21/065 2/228 |

(Continued)

*Primary Examiner* — Andrew W Collins
*Assistant Examiner* — Brieanna Szafran
(74) *Attorney, Agent, or Firm* — Plager Schack LLP

(57) ABSTRACT

Protective devices that are substantially simultaneously used as adjustable weighted resistance training devices are disclosed. More specifically, embodiments of the present invention are directed to improved, adjustably weighted protective shin guards that can extend to integrate instep protection.

4 Claims, 10 Drawing Sheets

(56) References Cited

U.S. PATENT DOCUMENTS

| | | | | |
|---|---|---|---|---|
| 6,039,677 | A * | 3/2000 | Spletzer | 482/105 |
| 6,244,997 | B1 * | 6/2001 | Cook | A63B 21/065 482/105 |
| 7,090,624 | B1 * | 8/2006 | Chrishon | 482/105 |
| 7,376,979 | B2 * | 5/2008 | Nilsen | A63B 21/065 2/69 |
| 8,944,974 | B2 * | 2/2015 | Foster | A41D 13/0015 482/124 |
| 2006/0172870 | A1 * | 8/2006 | Virji | 482/105 |
| 2008/0120756 | A1 * | 5/2008 | Shepherd | 2/22 |
| 2008/0280737 | A1 * | 11/2008 | Cook | 482/105 |
| 2008/0306423 | A1 * | 12/2008 | Gould | 602/27 |
| 2010/0000006 | A1 * | 1/2010 | Butler | 2/160 |
| 2010/0311551 | A1 * | 12/2010 | Winston | 482/105 |

* cited by examiner

MULTI-PURPOSE TRAINING APPARATUS AND METHOD

CROSS-REFERENCE

This application claims the benefit of the priority of presently pending Provisional U.S. Application No. 61/473,975 filed Apr. 11, 2011, entitled "Dual Purpose Training Apparatus and Method", and is incorporated by reference herein in its entirety.

FIELD OF THE INVENTION

The present disclosure is directed towards protective devices that can be used substantially simultaneously as adjustable, weighted training devices. More specifically, embodiments of the present disclosure are directed to improved, protective shin/instep guards that incorporate adjustably weighted resistance for enhanced leg training.

BACKGROUND

Weighted exercise devices that are worn about the arms, ankles and other body parts are known. Such devices have been used to increase muscle development and workout efficiency, as the various muscle groups of the body in the region where such devices are worn are taxed, or have an increased resistant force due to the added weight. Many known athletic sporting activities benefit from training devices that isolate specific muscle development and strength. In addition, many sports require known protective apparatuses that are worn during training, or during participation in the sport itself, to protect various parts of the body from injury.

SUMMARY OF THE INVENTION

A single, versatile apparatus and system that is able to combine both the protective function during activities such as, for example, sparring etc., with the advantage of resistance training would be highly advantageous, especially for training in contact fight sports/arts, such as, for example, martial arts, kickboxing, muay thai, karate, tae kwon do, etc.

One aspect of the present disclosure is directed to a method for increasing athletic performance comprising the steps of providing a device to be securely and removably fixed to a human leg, and most preferably a human lower leg. The device comprises a sleeve dimensioned to receive a leg and orient and maintain the apparatus at a predetermined location on a leg. In one preferred embodiment, the sleeve is attached to, or is integral with a segment of the device. The segment is attached to or is integral with at least one securing strap. The securing strap comprises at least one chamber that is preferably dimensioned to removably receive at least one weighted element. The device is positioned on the leg and further secured to the leg with the securing strap. Preferably, the device substantially simultaneously protects and develops the leg and body. The device preferably further comprises a lower segment that is juxtaposed to the upper segment. The lower segment preferably comprises a flexible portion dimensioned to at least partially cover a human instep.

The present disclosure is further directed to an apparatus for protecting and developing a human leg comprising a sleeve dimensioned to receive a human leg. The sleeve orients and maintains the apparatus at a predetermined location on the leg. A segment of the apparatus is attached to, or is integral with the sleeve. Optionally, at least one securing strap is attached to the segment and the securing strap comprises at least one chamber dimensioned to removably receive at least one weighted element. Preferably, the device substantially simultaneously protects and develops a leg. The device preferably further comprises a lower segment that is juxtaposed to the upper segment. The lower segment preferably comprises a flexible portion dimensioned to at least partially cover a human instep.

Still further, the present disclosure is directed to an apparatus for protecting and developing a leg and body comprising a sleeve dimensioned to receive a human leg. The sleeve orients and maintains the apparatus at a predetermined location on the leg. The sleeve comprises at least one chamber dimensioned to removably receive at least one weighted element. Preferably, the device substantially simultaneously protects and develops a leg. The device preferably further comprises a lower segment that is juxtaposed to the upper segment. The lower segment preferably comprises a flexible portion dimensioned to at least partially cover a human instep.

According to preferred embodiments, the present disclosure provides a weighted shin-instep/shin-guard that uses pre-selected and preferably progressive amounts of weight, preferably to add resistance to training, such as, for example, kick-training, etc., for the purpose of increasing kicking speed/velocity, kicking force and leg strength, muscle stamina, etc. Presently known devices achieve and increase leg strength without protective benefit, by adding weights around and about the ankle. However, such ankle weights, while providing resistance, only serve to create undue stress on the ankle, and additionally pose a risk of serious injury such as, for example, injury to the bones in the ankle and foot, especially when used in kick-training. This risk is substantially increased with the use of existing resistance apparatuses (namely, conventional ankle weights, combined with the use of separate protective equipment namely shin/instep guards) for the purpose of kick-training on a heavy bag, or other padded striking apparatus. This risk of injury with presently available separate equipment combinations is due, among other reasons, to the necessary imperfect fit of the weight apparatus over a padded shin or shin-instep/shin guard, as opposed to directly securing the weight apparatus to the lower leg or ankle.

Preferred embodiments of the present disclosure provide a unique training tool that combines the advantages of removably adjustable weighted resistance, with a high-quality padded protective shin-instep/shin guard that has the dual function of being able to be used to kick/strike an inanimate object, such as, for example, a heavy bag or other padded apparatus, etc. when the weights are in place, but is also designed to make contact or strike a human participant or opponent for sparring or partner training when the weights are removed. The weights are therefore, removable from the device without having to remove the training apparatus from the leg, or changing apparatuses as is done conventionally. By contrast, conventional practice requires a user to combine a high quality shin or shin/instep guard with separate weighted apparatuses, that must then be removed prior top human sparring. Significant problems arise when combining any known resistance weighted apparatus that are uniformly not intended to be worn in combination with a protective guard. Effecting such an unintended combination of known devices during partner training can result in serious injury to the user and the sparring partner. In addition, the unintended combination of known devices creates an unsecure fit, as the weighted apparatuses are not intended to be worn over a padded shin or shin/instep guard while kicking a heavy bag or other inanimate padded apparatus, thereby posing a threat of injury to the bones of the foot and/or ankle due to, for example unanticipated and undesired spinning or other movement, etc., of the weighted device caused by the weighted device necessarily being insecurely affixed to the human leg.

According to further embodiments, the present disclosure has removable weights that are integral to the shin-instep device. It is contemplated that the weights are either provided into an integral chamber individually, or are provided into a secondary container, or pouch designed to provide enhanced stabilization and orientation of the weights therein. Embodiments of the present invention contemplate a single training tool that has, for the first time, the capability of providing padded protection during resistance training on a heavy bag with the weights inserted therein, as well as providing padded protection without the weights inserted therein during partner training, without needing to change gear when switching from human sparring to inanimate object striking and other resistance training.

Preferably, embodiments of the present disclosure further have the weight substantially evenly distributed across the back of the leg to minimize strain in any single area, such as, for example, the ankle.

BRIEF DESCRIPTION OF THE DRAWINGS

The objects and advantages of the embodiments of the invention will become more readily apparent to those of ordinary skill in the field after reviewing the following detailed description and accompanying drawings wherein.

DETAILED DESCRIPTION OF THE INVENTION

Preferred embodiments of the present disclosure predictably shape and distribute weight about a leg, allowing the user to have resistance weight on the legs for kick-training, without having to separately strap on ankle weights. Therefore, according to the present disclosure, with the removable weights inserted, the weight is substantially evenly distributed, as desired, across the calf area of the leg to avoid stress on the ankle, or any single area of the leg. The user is therefore able to substantially simultaneously kick a heavy bag or other apparatus, etc. as the shin/instep is sufficiently padded, while adding resistance through resistance training for the purpose of increasing kick force, kick speed/velocity, leg strength, muscle stamina, etc. Particularly advantageous to the design of preferred embodiments, the present disclosure contemplates merely removing the weights from the protective device, but keeping the protective device on, as the user progresses from a training session against, for example, inanimate objects, to sparring with human participants.

The present disclosure further relates to a weighted shin-instep/shin guard. Specifically, the present invention contemplates a shin-instep/shin guard that is shaped, supported and padded with integral removable weights inserted into cavities. The cavities or chambers are preferably positioned on the back of strap elements attached to the main body segment, such that, when the straps are fastened in place, the weight is distributed over the generally dorsal (back) side of the back of the leg, causing a desired, predicted and pre-selected increase in resistance on the leg when kicking. Alternatively, the cavities or chambers may be added to or may be integral with the sleeve. According to still further embodiments, the shin-instep/shin guard of the present disclosure can be dimensioned to extend beyond the ankle to the foot to cover the instep, or it can be restricted to the shin area.

Figure 1A:
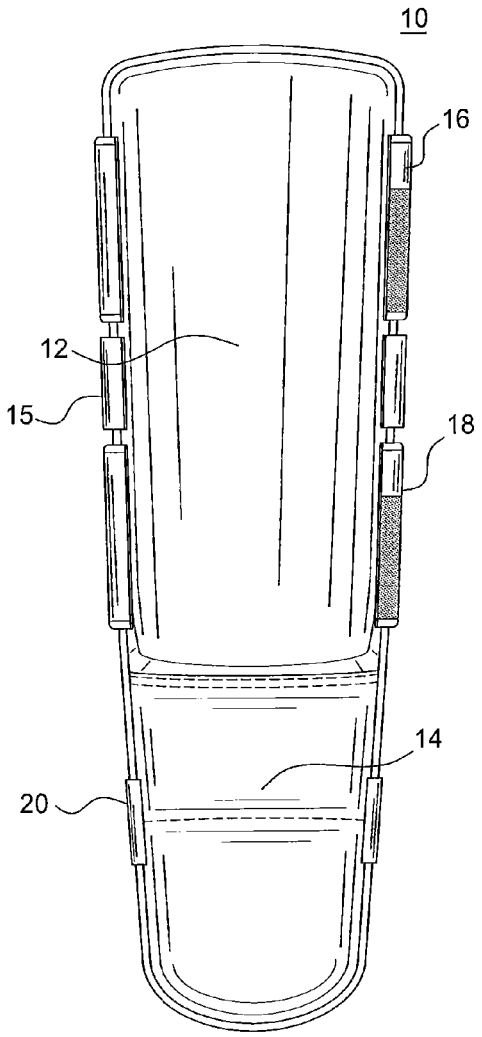
FIGS. 1*a* and 1*b* show the front view and back view respectively of one embodiment of the invention with strap elements secured in place.
Figure 1B:
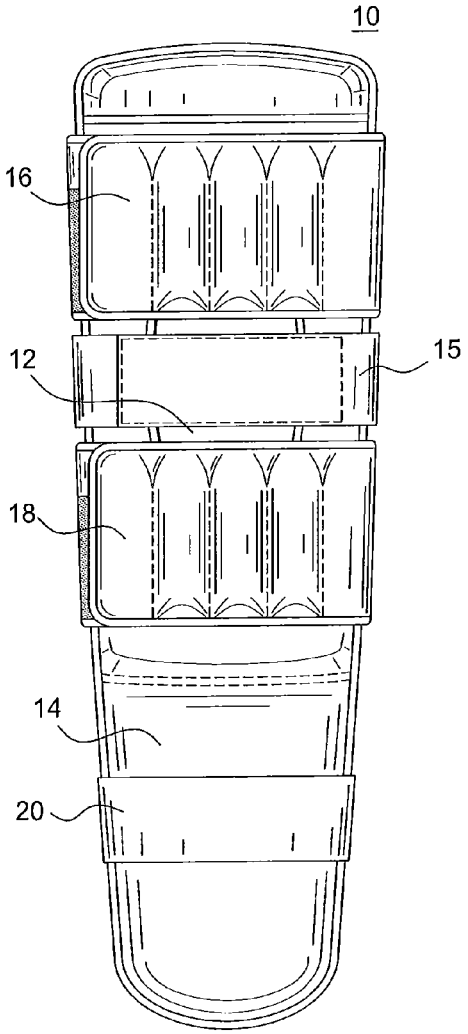

According to embodiments of the present disclosure, FIGS. 1*a* and 1*b* show the front view and back view respectively of one embodiment of the invention with strap elements secured in place. As shown in FIG. 1*a*, weighted shin-instep/shin guard 10 comprises a cushioned section, or upper segment 12 that substantially covers at least the lower portion of a shin integral with, or otherwise connected to a flexible cushioned lower section or segment 14 that substantially covers at least the instep of a wearer. FIG. 1*b* shows the back of weighted shin-instep/shin guard 10 with strap elements 16, 15, and 18 secured in place via integrated attachment means, such as, for example a Velcro™ strap (not shown). The back side of lower section 14 shows foot strap 20.

Figure 2:
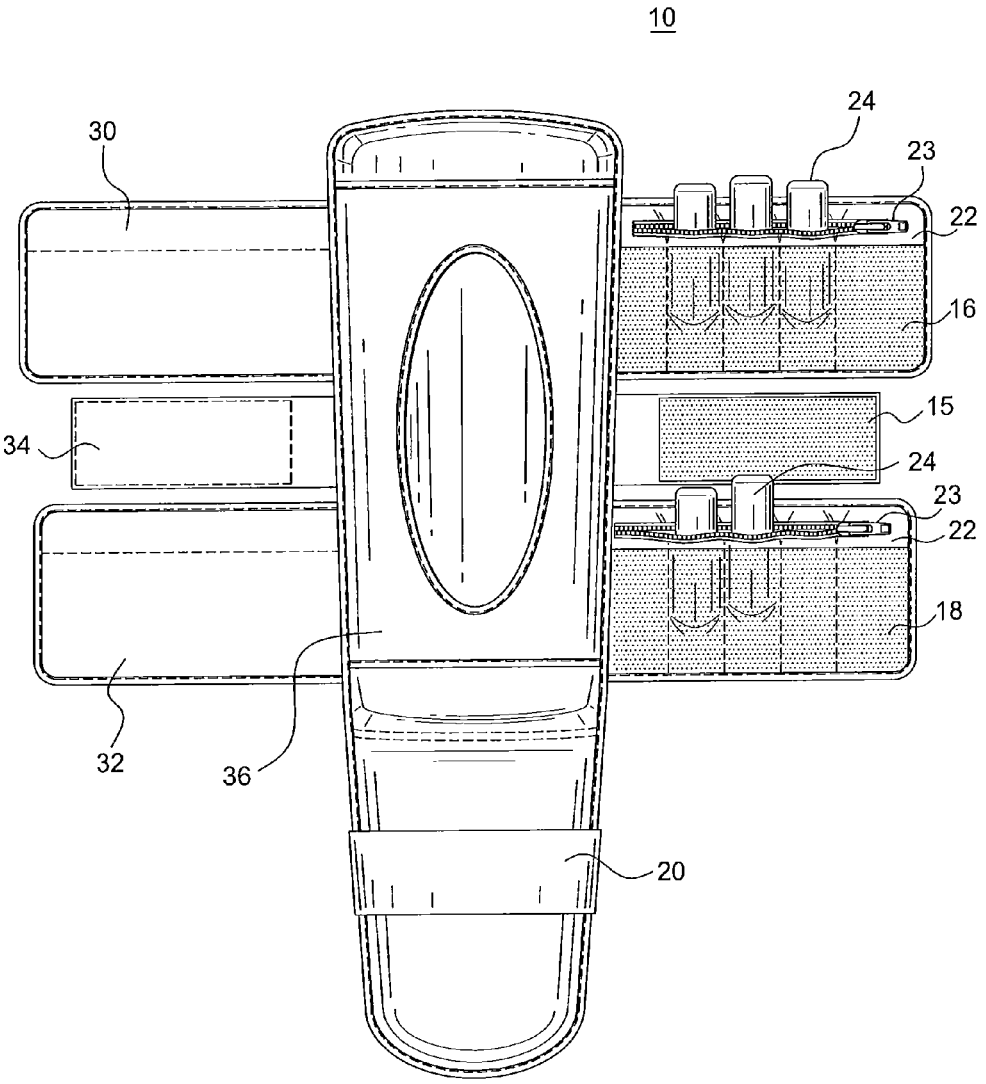
FIG. 2 shows a view of the inside of the apparatus shown in FIGS. 1*a* and 1*b*, with strap elements (extended) having chambers dimensioned to receive weighted elements.
Figure 7:
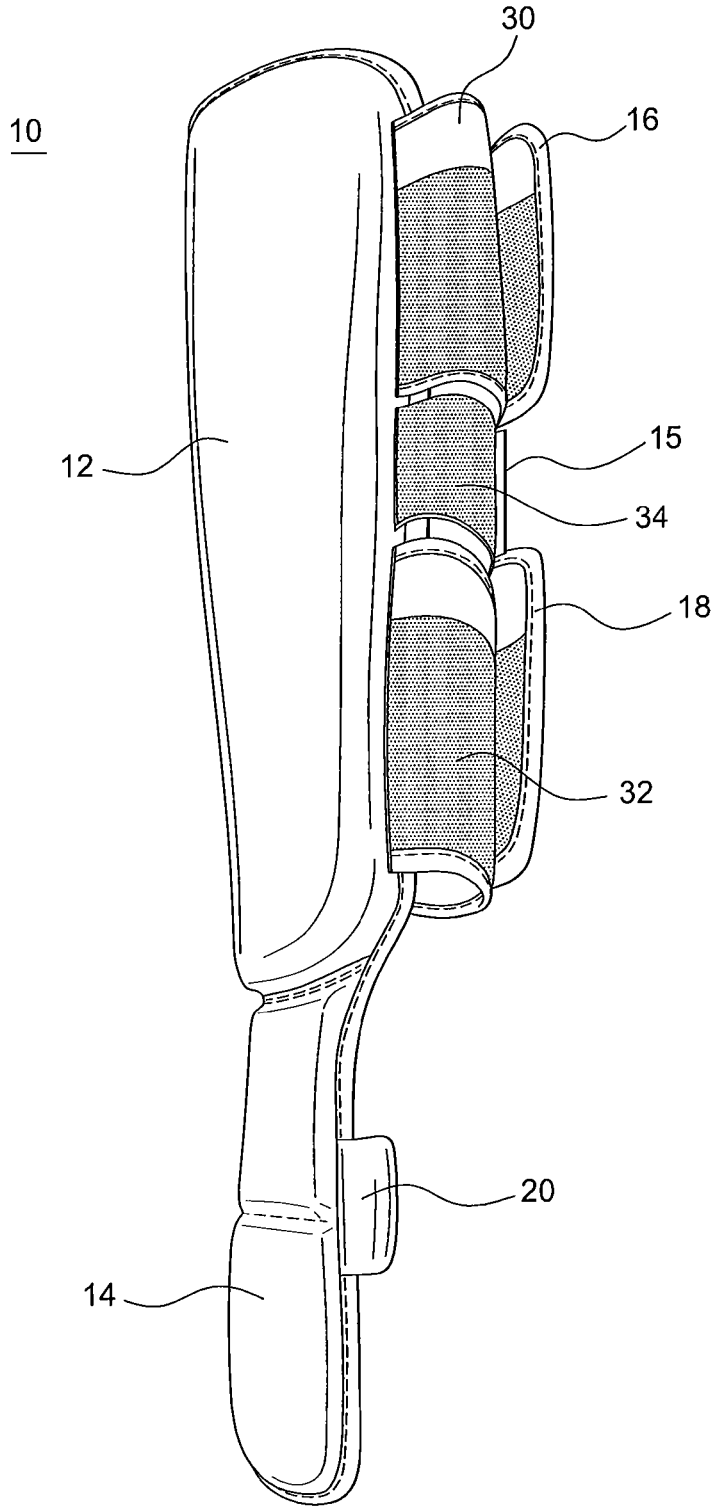
FIG. 7 shows a perspective side view of the apparatus shown in FIG. 1*a*.

FIG. 2 shows a view of the inside and back of the weighted shin-instep/shin guard 10 with straps opened. Strap elements 16 and 18 each comprise chamber 22 for receiving at least one weighted element 24. As shown, chamber 22 comprises a zippered element 23 that can be closed to help maintain the weighted element 24 in place within chamber 22. Additional support strap 15 is shown. The inner surface of strap elements 15, 16 and 18 comprise a surface (shaded area) for facilitating attachment to a complementary strap element. The surface preferably comprises a Velcro™-type material, or any loop and hook-type, or other type of securing material or securing means as would be readily understood. Leg sleeve 36 is attached to the inside of section 12 of weighted shin-instep/shin guard 10. It is understood that leg sleeve 36 is dimensioned to accommodate a lower leg, preferably in a snug fit. Therefore, leg sleeve 36 preferably comprises a resilient and stretchable material. A wearer's foot and lower leg would be inserted into sleeve 36. Complementary straps elements 30, 34, and 32 preferably comprise a layer of a Velcro™-type material on the side (not shown, but indicated by the area bounded by the dotted line) that will contact the shaded area of straps 16, 15 and 18 when the straps are in position around a leg. Any loop and hook-type securing material, or other type of securing material or securing means may be used, as would be readily understood. Complementary strap elements 30, 34 and 32 would then be brought around the back of the wearer's lower leg and into contact with sleeve 36. Strap elements 16, 15 and 18 would then be brought around the back of the wearer's lower leg, engaging complementary strap elements 30, 34 and 32 respectively. FIG. 7 shows a side view of the shin-instep/shin guard 10 of FIG. 1*a*.

Figure 3:
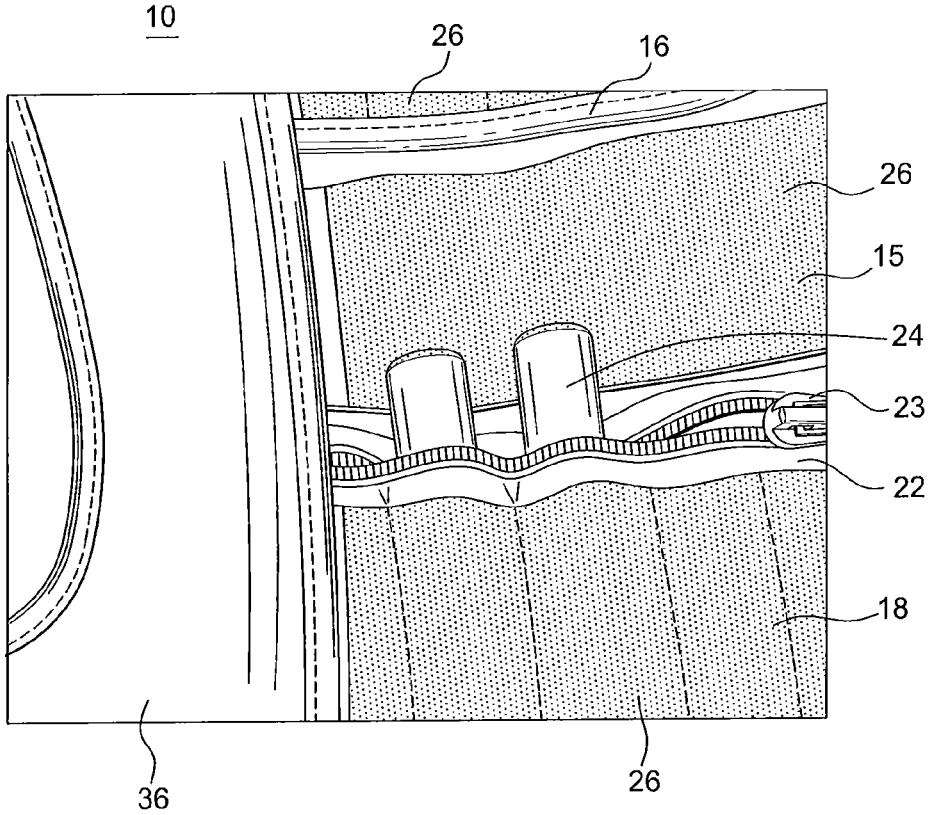
FIG. 3 is a close-up view of the apparatus shown in FIG. 2.

FIG. 3 shows a close-up view of the inside of shin-instep/shin guard 10, showing a portion of leg sleeve 36, support strap 15, and strap elements 16 and 18 . Strap element 18 shows a chamber 22 (with zippered element 23), dimensioned to receive at least one weighted element 24. The inside of support strap 15, and strap elements 16 and 18 each have a surface (shown as a shaded region) 26 for facilitating attachment to a complementary strap element (not shown). The surface preferably comprises a Velcro™-type material, or any loop and hook-type securing material or other type of securing material or securing means, as would be readily understood.

Figure 4:
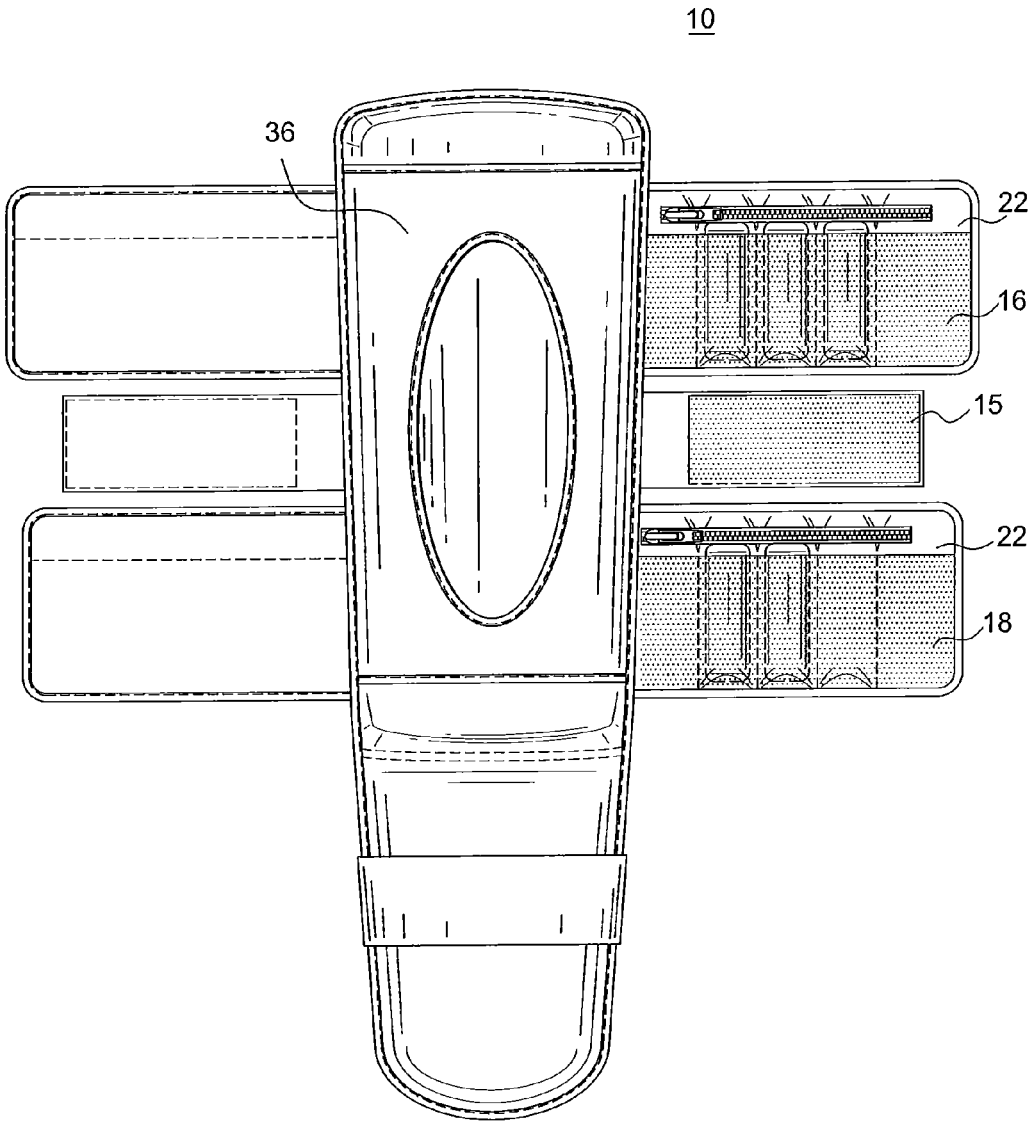
FIG. 4 shows a view of the apparatus of FIG. 2 showing straps with the chambers zipped in a closed position.
Figure 5:
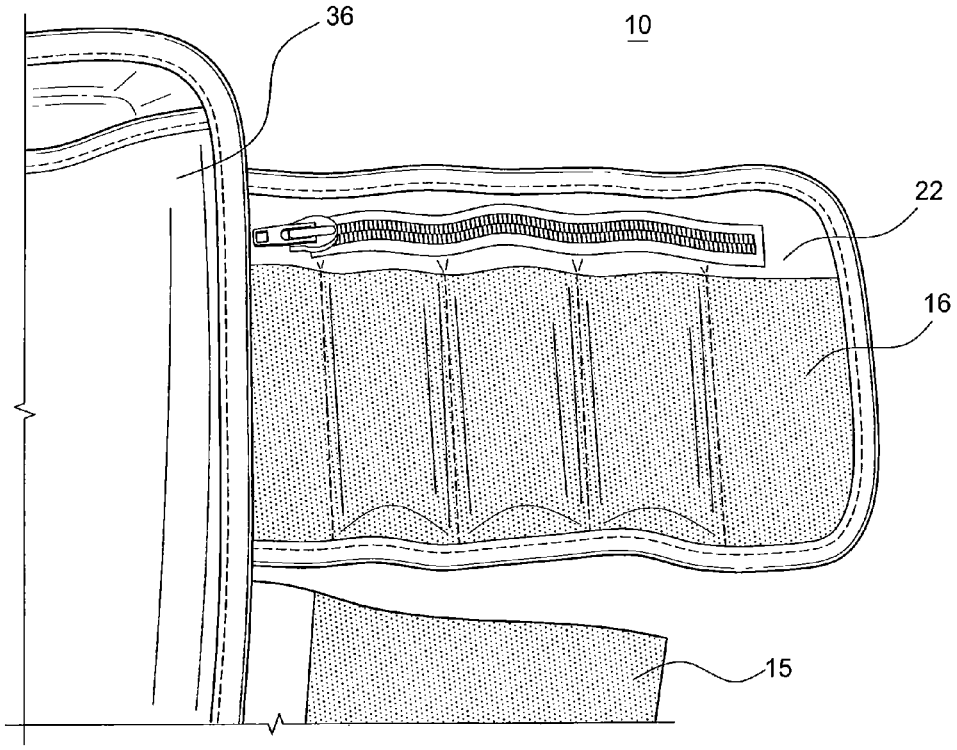
FIG. 5 shows a close-up view of the apparatus shown in FIG. 4.

FIG. 4 shows a view of the inside of shin-instep/shin guard 10, showing leg sleeve 36 and showing chambers 22 on strap elements 16 and 18 in a zipped/closed position. FIG. 5 is a close up view of strap element 16 showing chamber 22 in a zipped/closed position.

Figure 6:
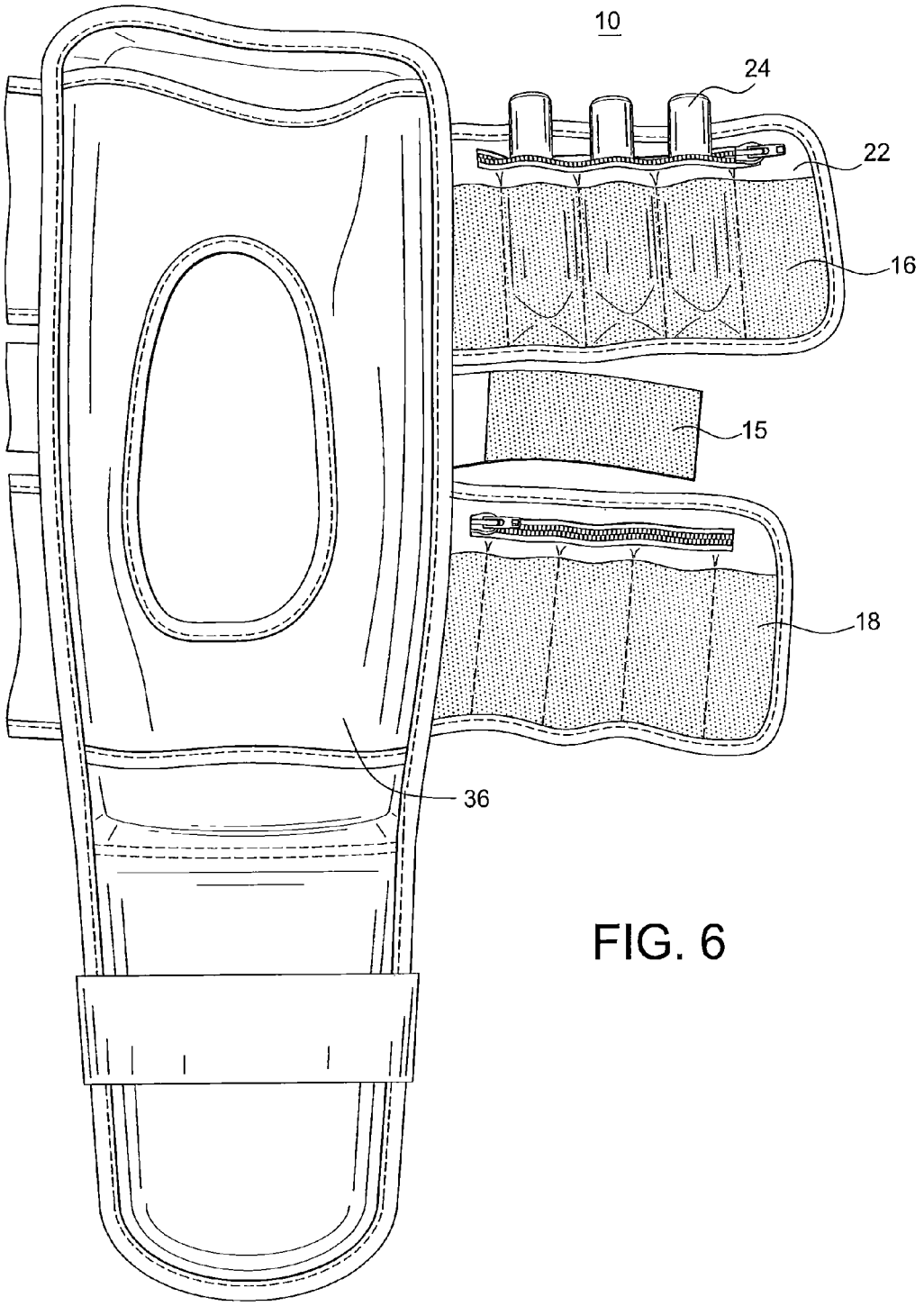
FIG. 6 shows the apparatus of FIG. 2, with one of the chambers in the closed position.

In FIG. 6, weighted elements 24 are only shown in chamber 22 of strap element 16. It is understood that chamber 22 is dimensioned to completely receive weighted elements 24 into a secure position within chamber 22. Indeed, embodiments of the present invention contemplate the presence of dividers and/or other securing means (not shown) within the chamber for retaining the weighted elements in a desired orientation within the chamber, such that the weighted elements undergo a minimum of movement or shifting, and are instead held in a substantially fixed position within the chambers.

Figure 8:
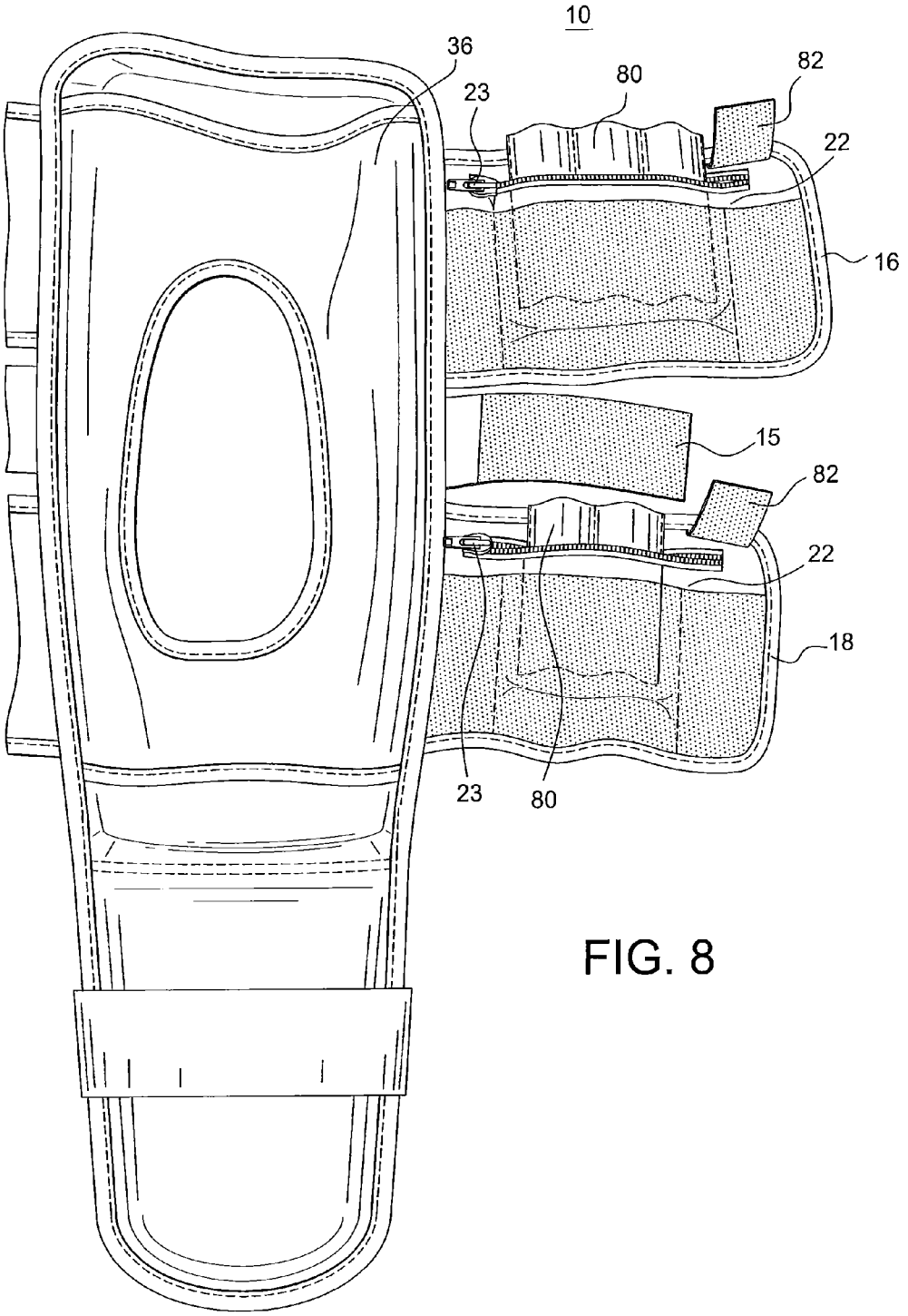
FIG. 8 shows a view of one embodiment of the present invention with the chamber comprising a container to support and position the weights in a predetermined orientation.
Figure 9:
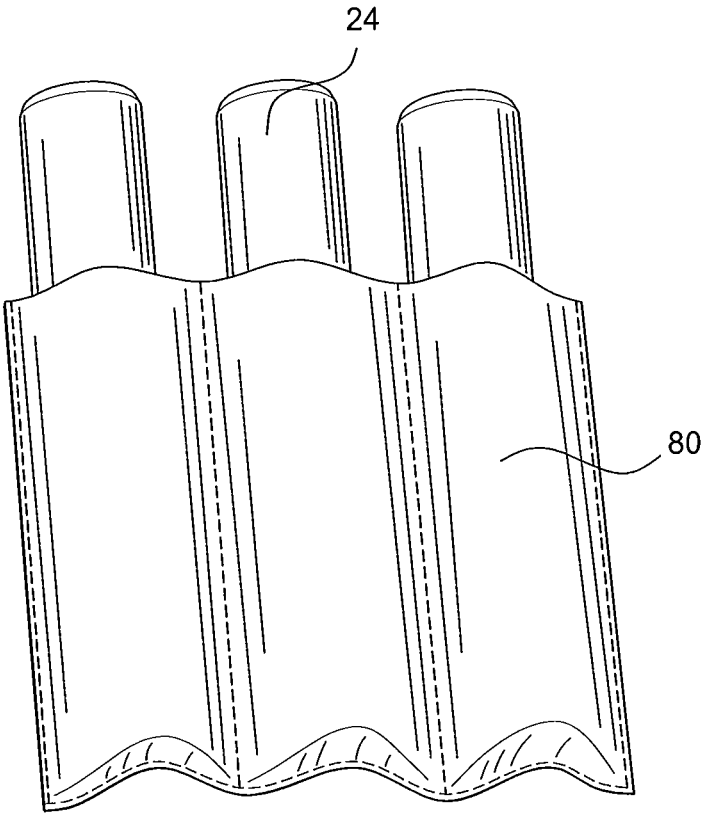
FIG. 9 is a close-up view of the container partially shown in FIG. 8.

FIG. 8 shows a view of one embodiment of the present invention where shin-instep/shin guard 10 comprises straps 16, 15, 18 and sleeve 36. Straps 16 and 18 each comprise a chamber 22 that in turn comprises a removable pouch or container 80 dimensioned to receive one or more weights 24. Container 80 is further dimensioned to fit inside chamber 22. In this embodiment, the weights 24 are held more securely in their desired orientation and are less prone to slippage and movement within the chamber 22, especially when the shin-instep/shin guard is in use. As shown, the inside of straps 16 and 18 comprising chambers 22 further comprise a protective flap 82, preferably having a Velcro™-type material such that protective flap 82 may engage a surface of straps 16, 18 to protectively cover zipper pull tabs 23 when the zipper is pulled to its "closed" position, closing chamber 22. FIG. 9 is a close-up view of container 80 showing the weights 24 held in place.

Figure 10:
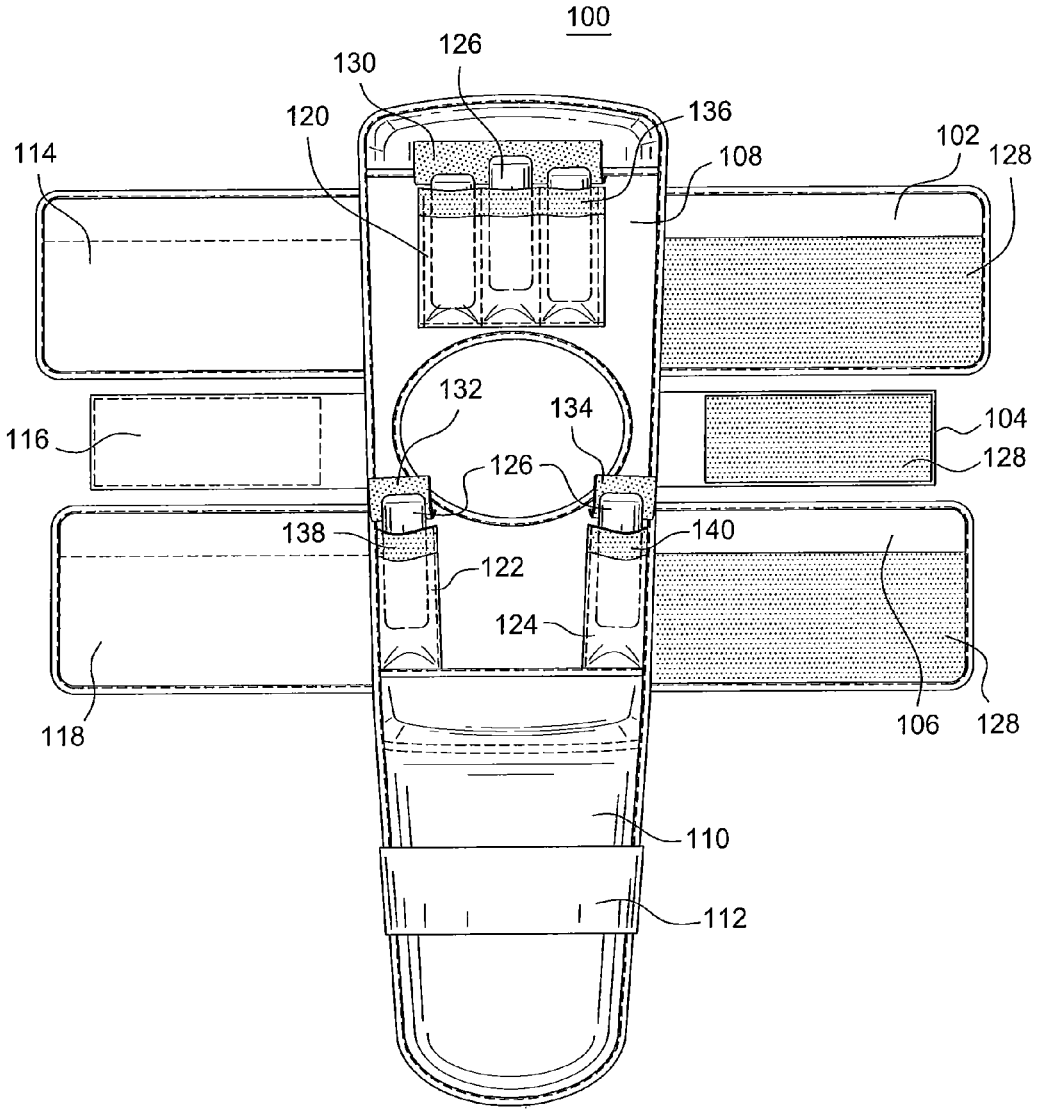
FIG. 10 shows a perspective view of an alternate embodiment of the present invention where the weights are insertable and maintainable in the sleeve.

FIG. 10 shows an alternate embodiment of the present disclosure. Shin-instep/shin guard 100 comprises straps 102, 104 and 106 each attached to sleeve 108. Sleeve 108 comprises integral sleeve chambers 120, 122 and 124 into which weights 126 may be inserted and retained. Sleeve chambers 120, 122 and 124 comprise a securing flap 130, 132 and 134 respectively. Flaps 130, 132 and 134 comprise a Velcro™-type material indicated by a shaded region. Sleeve chambers 120, 122 and 124 also comprise a Velcro™-type material indicated by shaded regions 136, 138 and 140 respectively that each mate with the Velcro found on the underside of flaps 130, 132 and 134. It is understood that protective flaps, zippered closures or other closure means, etc. may be used to retain, or further retain the weights 126 in place within chambers 120, 122 and 124. Straps 102, 104 and 106 preferably comprise a layer of Velcro™-type material 128. According to the apparatus shown in FIG. 10, a leg would be inserted into sleeve 108, sleeve 108 providing a snug fit. The foot would preferably extend beyond sleeve 108 and rest adjacent flexible segment 110. Foot strap 112 is integral with, or otherwise attached to, flexible segment 110, and is designed to surround a foot to securely hold flexible segment 110 to a foot instep. With the leg and foot positioned in this way, straps 114, 116 and 118 are brought around the leg (behind the calf). Layers of Velcro™-type material on the sides of straps 114, 116 and 118 that are not shown in FIG. 10 then come into contact with the Velcro™-type material 128 as straps 102, 104 and 106 are brought around the leg (behind the calf).

The apparatuses and methods of the present disclosure are useful in increasing and otherwise developing speed/velocity, increasing force, strength and stamina, such as, for example, in the user's leg strikes, etc., by adding resistance in kick-training. According to the present invention, the shin-instep/shin guard of the present invention conveys significant additional benefits as the device is a substantially simultaneously protective device to the user and a resistance weight-training device when weights are in place, and is also a fully functional protective device with the weights in or out of place.

Embodiments of the invention contemplate having a varying numbers of pockets or chambers that may vary in dimension as desired, for housing the removable weights. Preferably varying-sized guards may have varying sized or varying numbers of weight pockets and weights. Preferably, individual pockets or chambers are sewn into the back of supporting straps to house each removable weight, preferably with a zipper closure, but any other secure closure means and methods are also contemplated. The zipper is preferably positioned on the inside of the strap, and preferably covered, so that it is not exposed, and therefore avoids any cutting or abrasions when the shin-instep/shin guard is used in sparring against an opponent with or without the weights. The weights are preferably positioned to rest on the calf area of the leg but could be applied to the sides of the leg or at any other location as desired. Preferably, the weights are solid metal or metal shot, but further embodiments of the present invention contemplate using water, sand, or any other dense material, etc. alone or in combination.

The padding on the front of the weighted shin-instep/shin-guard is meant to protect the wearer and opponent/other participant from impact when sparring/kicking an opponent. According to still further embodiments, the present invention comprises an integral instep protector that is joined to, and extends from, the main body of the guard that substantially covers and protects the wearer's foot as well as the opponent from impact from the wearer's foot. The integral instep protector preferably incorporates a strap located on the underside, into which a foot may be placed for stability. The integral instep protector is located proximate to, or otherwise joined to the main body of the guard by a flexible padded part to allow intended mobility of the foot relative to and separate from the leg.

According to embodiments of the present disclosure, the padding protects the bones in the shin, the ankle and the foot. The present disclosure further contemplates a design that would substantially cover only the shin area, with the shin area protected with padded material. Still further embodiments of the present disclosure contemplate a protective multi-purpose training device for use with other appendages of the body including arms and hands.

The padded material may be made from any material suitable to provide padding benefits, and being able to sustain and absorb significant repetitive impact. Such materials include latex foam, polyurethane (PU) foam of varying densities, injection molded foam, open-cell foam and gel padding, cap-cell polyethylene sheet foam, etc., and ethylene vinyl acetate foam (EVA), with EVA foam being particularly preferred. It is understood that the entire outer front and side covering of the preferred embodiments of the present invention may be any natural or synthetic material selected for its usefulness and durability relative to being able to sustain significant repetitive impact and to preferably contain an inner padded material. Such materials include natural and synthetic leather (PU and polyvinyl chloride (PVC) leathers), neoprene, canvas, etc., with leather for the top/outer portion and polyester fabric for the inner liner that is in contact with the wearer's skin being particularly preferred.

According to still further embodiments, the user can adjust the amount of resistance by either increasing or decreasing the number of removable weights inserted into the weighted shin-instep/shin guard. Preferably, Velcro™ straps are used to secure the weighted shin-instep to the leg, along with an integrated elastic sock backing or sleeve into which a leg would be inserted. However, the present disclosure also contemplates a version of the shin-instep/shin guard where removable weights are inserted into chambers present in the sleeve, and where no securing straps are required. Other methods to secure the weighted shin-step to the leg are contemplated, as would be readily apparent to one skilled in the field, however, an elastic sleeve and straps are thought to create a more secure fit to hold the shin-instep/shin guard in place so that it does not move, for example "spin", or otherwise rotate from its desired positioning on the leg, especially with the weights inserted, upon impact.

The sleeve is preferably made from an elastic material that is preferably sturdy, such as, for example, neoprene, etc. The only requirement for the sleeve material is that it can position and maintain the shin-instep/shin guard securely on the lower part of the leg, and restrict its movement during activities, such as, for example, sparring, kick-training, etc.

Numerous other aspects of embodiments, embodiments, features, and advantages of the present invention will appear from the following detailed description and the accompanying drawings. In the description and/or the accompanying drawings, reference is made to exemplary aspects of embodiments and/or embodiments of the invention which can be applied individually or combined in any way with each other. Such aspects of embodiments and/or embodiments do not represent the full scope of the invention. Reference should therefore be made to the claims herein for interpreting the full scope of the invention.

I claim:

1. An athletic training method:

providing a protective athletic training shin/instep/shin-guard apparatus comprising:

a sleeve configured to be dimensioned to receive a leg of a wearer and orient said apparatus at a predetermined location on the leg; the sleeve further comprising a front side and a back side, wherein the back side further comprises a central opening;

a flexible cushioned lower section, attached to the sleeve; wherein the flexible cushioned lower section is adapted to substantially cover an instep of the wearer;

a cushioned upper segment, attached to the flexible cushioned lower section; wherein the cushioned upper segment is adapted to substantially cover at least a lower portion of a shin of the wearer; the cushioned upper segment attached to the front side of the sleeve above the a flexible cushioned lower section;

a support strap, attached to a first side of the sleeve;

a complimentary support strap element; attached to a second side of the sleeve and wherein the complimentary support strap element is adapted to connect to the support strap around a back of the sleeve;

wherein the support strap covers a portion of the central opening;

an upper strap element, attached to the first side of the sleeve above the support strap;

a complimentary upper strap element, attached to the second side of the sleeve and wherein the complimentary upper strap element is adapted to connect to the upper strap element around the back of the sleeve;

an upper strap element chamber, attached to a back side of the upper strap element;

an upper strap weighted element;

inserting the upper strap weighted element into the upper strap chamber;

a lower strap element, attached to the first side of the sleeve below the support strap;

a complimentary lower strap element, attached to the second side of the sleeve and wherein the complimentary lower strap element is adapted to connect to the lower strap element around the back of the sleeve;

a lower strap element chamber, attached to a back side of the lower strap element;

a lower strap weighted element;

inserting the lower strap weighted element into the lower strap chamber;

positioning the device on the leg; and securing the device with the securing strap.

2. The method of claim 1, further comprising the step of: substantially simultaneously protecting and developing a leg.

3. A protective athletic training shin/instep/shin-guard apparatus comprising:

a sleeve configured to be dimensioned to receive a leg of a wearer and orient said apparatus at a predetermined location on the leg; the sleeve further comprising a front side and a back side, wherein the back side further comprises a central opening;

a flexible cushioned lower section, attached to the sleeve; wherein the flexible cushioned lower section is adapted to substantially cover an instep of the wearer;

a cushioned upper segment, attached to the flexible cushioned lower section; wherein the cushioned upper segment is adapted to substantially cover at least a lower portion of a shin of the wearer; the cushioned upper segment attached to the front side of the sleeve above the a flexible cushioned lower section;

a support strap, attached to a first side of the sleeve;

a complimentary support strap element; attached to a second side of the sleeve and wherein the complimentary support strap element is adapted to connect to the support strap around a back of the sleeve;

wherein the support strap covers a portion of the central opening;

an upper strap element, attached to the first side of the sleeve above the support strap;

a complimentary upper strap element, attached to the second side of the sleeve and wherein the complimentary upper strap element is adapted to connect to the upper strap element around the back of the sleeve;

an upper strap element chamber, attached to a back side of the upper strap element;

an upper strap weighted element, inserted into the upper strap chamber;

a lower strap element, attached to the first side of the sleeve below the support strap;

a complimentary lower strap element, attached to the second side of the sleeve and wherein the complimentary lower strap element is adapted to connect to the lower strap element around the back of the sleeve;

a lower strap element chamber, attached to a back side of the lower strap element;

a lower strap weighted element, inserted into the lower strap chamber.

4. The apparatus of claim 3, wherein the central opening is oval shaped.

* * * * *